US005947597A

United States Patent [19]

King

[11] Patent Number: 5,947,597

[45] Date of Patent: Sep. 7, 1999

[54] MODIFIED DUAL VISCOSITY MIXER

[75] Inventor: Leonard Tony King, Long Beach, Calif.

[73] Assignee: Komax Systems, Inc., Long Beach, Calif.

[21] Appl. No.: 09/005,427

[22] Filed: Jan. 9, 1998

[51] Int. Cl.[6] ..... B01F 5/06

[52] U.S. Cl. ..... 366/181.5; 366/338

[58] Field of Search ..... 366/181.5, 336, 366/337, 338, 340; 138/37, 39, 40

[56] References Cited

U.S. PATENT DOCUMENTS

| | | | |
|---|---|---|---|
| 2,784,948 | 3/1957 | Pahl et al. | 366/181.5 |
| 2,831,754 | 4/1958 | Manka | 366/181.5 |
| 4,441,823 | 4/1984 | Power | 366/340 |
| 4,808,007 | 2/1989 | King | 366/336 |
| 4,812,049 | 3/1989 | McCall | 366/181.5 |
| 5,597,236 | 1/1997 | Fasano | 366/338 |
| 5,743,637 | 4/1998 | Ogier | 366/338 |

*Primary Examiner*—Charles E. Cooley
*Attorney, Agent, or Firm*—Malcolm B. Wittenberg

[57] ABSTRACT

A device for mixing two or more fluids which includes an elongated hollow tubular member having a longitudinal axis which is constricted intermediate its ends. The constriction includes at least two orifices carrying a first fluid which are situated and sized within the hollow tubular member so that the orifices have a point of substantial mutual tangency. A fluid entry port is provided for discharging a second fluid at a point substantially coincident with the point of substantial mutual tangency of the orifices. The fluid entry port for discharging the second fluid is a second fluid discharge tube located at the point of substantial mutual tangency. The discharge tube is provided with an axis coextensive with the longitudinal axis of the hollow tubular member noting that a gap is provided proximate the point of substantial mutual tangency surrounding the second fluid discharge tube to enable a quantity of first fluid to pass through the gap as the first fluid passes through the orifices located within the constriction.

3 Claims, 3 Drawing Sheets

MODIFIED DUAL VISCOSITY MIXER

FIELD OF INVENTION

The present invention deals with a static mixing apparatus capable of enhancing the speed and efficiency of mixing two liquids having widely disparate viscosities. The invention is an improvement of that disclosed in applicant's U.S. Pat. No. 4,808,007 bearing common inventorship and assigned to the same assignee.

BACKGROUND OF THE INVENTION

It is common practice to mix particulate solids, liquids and gases with motionless mixers having, as the name implies, no moving parts. Mixers of this category consist of baffles of various types arranged sequentially in a tube or pipe. By a process of division and recombination, separate input components can be mixed or dispersed within one another at the output of said tube or pipe.

Difficulties are often experienced, however, when mixing materials of widely disparate viscosities and/or very different flow rates. For example, in the polymer field, it is at times desirable to mix very small quantities of a low viscosity material within a much larger quantity of a high viscosity material. When this is done, the low viscosity material tends to tunnel through the mixing elements without blending with the high viscosity material to any great extent. As an example, one might wish to mix a stream flowing at a rate of 7 gpm of a polymer having a viscosity of 30 million centipoises with a second stream traveling at 0.035 gpm of 6 centipoise material.

A variety of approaches have been attempted to produce an initial degree of dispersion or mixing at the injection point of the low viscosity material. These approaches have included, by way of illustration, the use of a multiplicity of injection ports around the circumference of a pipe. A second approach has consisted of the use of a relatively small diameter pipe for carrying the low viscosity material which passes through the diameter of the main pipe carrying the high viscosity material. The small diameter pipe is configured to have a plurality of holes used for injecting the low viscosity fluid. A common problem of such devices having parallel path outlets is that the low viscosity fluid injection apertures become differentially plugged resulting in asymmetric distribution.

It is well known that one of the mechanisms that allows for mixing of fluids is diffusion. However, when dealing with high viscosity materials which typically produce laminar flow, diffusion rates are very small. It is known that the rate of mass transfer N of the diffusion component measured in moles per second per unit area is equal to the diffusivity D multiplied by the local concentration gradient dC/dr. Thus, $$N=D(dC/dr)$$

Since D is small in high viscosity material, it is necessary to make the concentration gradient dC/dr large in order to maximize the value of the mass transfer rate N.

As being typical of a difficult mixing system is the development of a continuous polymerization of methyl methacrylate to produce the acrylic resin. This requires the introduction and intermolecular mixing of less than about one percent of a very low viscosity additive, about 6 cp, and to a high viscosity melt system. The latter viscosity is about 15 million cp at the operating shear rate. The problem is exacerbated by the desire to minimize thermal and mechanical abuse to the final product. First thought is given to the use of in-line or motionless, also called static, mixers. Although they represent savings in power and capital investment, when introducing a low viscosity liquid in to a high viscosity process stream, motionless mixers tend to be ineffective allowing the low viscosity liquid to simply tunnel through the high volume, high viscosity fluid.

Others have suggested the use of compounding extruders to mix additives into the polymer. This introduces heat, shear history and high energy costs. It was found, however, that perhaps a static mixer could be used if the appropriate entrance conditions were met. This recognition in and of itself, represents a rather significant departure from prior teachings which tend to encourage the use of static or motionless mixers only in turbulent flow conditions. When engaging in the polymerization of methyl methacrylate, the flow is highly laminar with a Reynolds number of approximately $10^{-4}$. As a solution to this problem, a distribution head was devised which, when used in conjunction with a static or motionless mixer, provides an effective mixing element principally due to the "sheeting" of the low viscosity additive prior to the introduction of the process stream into the motionless mixer element.

The device disclosed in applicant's U.S. Pat. No. 4,808,007 has been successfully applied to a wide variety of additive mixing problems. The device causes an additive to be introduced to the main fluid flow within a pipe or conduit in the form of a thin sheet. This generate a large interfacial area "A" in combination with a small interfacial thickness "t". It will be understood that a large A/t value is desirable in order to assist molecular diffusion and therefor mixing of the additive within the main product flow. The device is usually used in combination with a downstream static mixer to complete the mixing task.

The device disclosed in the '007 patent has been particularly useful in industrial manufacturing processes for a wide variety of plastics such as polyethylene, polystyrene and polymethylmethacrylate. In the production processing of such plastics, the melt viscosity of the polymer is typically in the range of $5\times10^5$ to $10\times10^6$ cp. The additives to be introduced and mixed within the main polymer are wide-ranging in type and properties. They include colorants, catalysts and lubricants. These have viscosities in the typical range of 0.5 to 100 cp.

It is understood that other physical properties, such as molecular diffusion rates, surface tension and specific gravity can affect the operation of the device. In some cases, for example, the additive is found to readily wet the outer walls of the conduit. Since low viscosity material will generally seek the highest shear rate at the conduit wall, the generation of additive sheet is compromised.

It is thus an object of the present invention to improve upon the invention disclosed in the '007 patent by reducing the tendency of the additive to wet the walls of the conduit while reducing any negative impact which such an improvement would have upon the A/t value discussed above. These and other objects of the present invention will be more readily apparent when considering the following disclosure and appended claims.

SUMMARY OF THE INVENTION

The present invention involves a device comprising an elongated substantially hollow tubular member having a longitudinal axis in which the hollow tubular member is constricted intermediate its ends with a mixing zone. The mixing zone, in turn, comprises at least two orifices for carrying a first fluid having substantially circular cross-sections and having longitudinal axes which are substantially parallel to the longitudinal axis of the substantially hollow tubular member. The orifices are situated and sized within the substantially hollow tubular member such that their substantially circular cross-sections have a point of substantial mutual tangency.

A fluid entry port for discharging a second fluid at the point substantially coincident with the point of substantial mutual tangency of the orifices is also provided.

The improvement which differentiates the present invention from that disclosed in U.S. Pat. No. 4,808,007, the disclosure of which is incorporated by reference, is directed to the modification of the device in the area of the fluid entry port for discharging the second fluid. This modification comprises providing a second fluid discharge tube located at said point of substantial mutual tangency, the second fluid discharge tube being provided with an axis substantially coextensive with the longitudinal axis of the substantially hollow tubular member. Further, a gap is provided proximate the point of substantial mutual tangency surrounding the second fluid discharge tube to enable a quantity of first fluid to pass through this gap as the first fluid passes through the orifices.

DETAILED DESCRIPTION OF THE INVENTION

Figure 1:
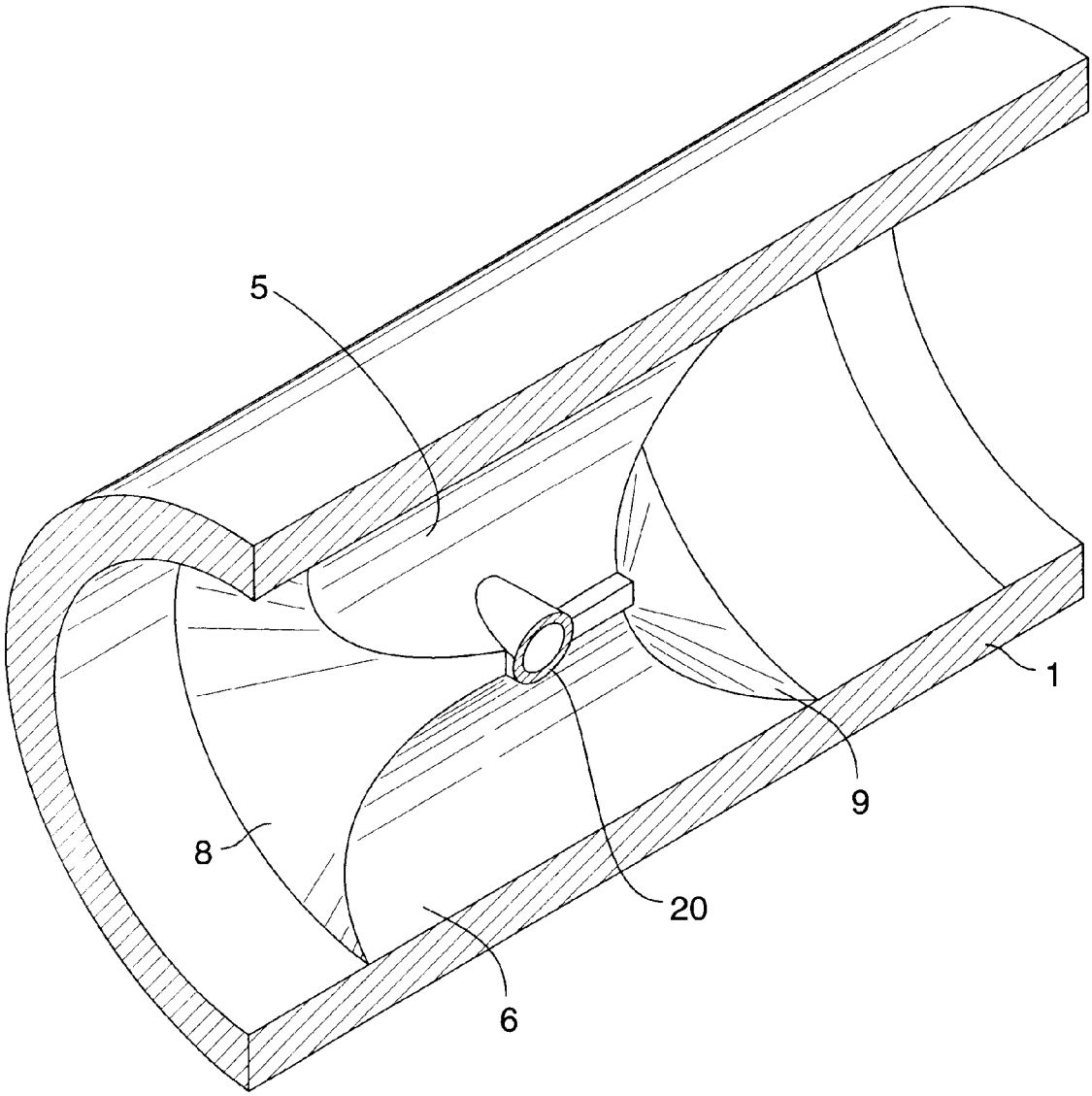
FIG. 1 (PRIOR ART)
FIG. 1 is an isometric representation taken in cross-section of the device of the '007 patent.

Referring to FIG. 1, mixing device 10 comprises a substantially hollow tubular member 1 which is constricted at 9, said constriction comprising orifices 5 and 6 for the passage of a relatively high viscosity fluid. It is contemplated that the cross-sections of the orifices are substantially circular, said definition encompassing obvious modifications such as oval shapes and the like.

Figure 2A:
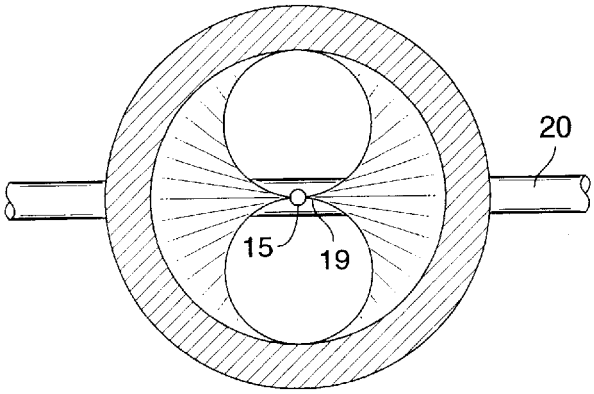
FIG. 2A (PRIOR ART)
FIG. 2A is a plan view of the device of FIG. 1.

It is contemplated that the two orifices for carrying the first fluid have longitudinal axes which are substantially parallel to the longitudinal axis of substantially hollow tubular member 1, and that orifices 5 and 6 be sized such that their substantially circular cross-sections have a point of substantial mutual tangency, shown at location 19 (FIG. 2A).

Referring again to the device shown in the '007 patent, its low viscosity fluid entry port 15 comprises an orifice located in hollow tube 20, which is shown radially extending through the side walls of elongated hollow tubular member 1. The low viscosity fluid is caused to enter the motionless mixer of the present invention through the hollow tube and its rate of discharge is controllable by pumping means (not shown).

Figure 2B:
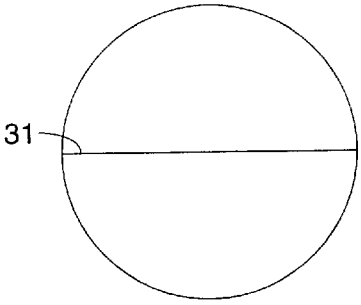
FIG. 2B (PRIOR ART)
FIG. 2B is a representation of the liquid flow pattern resulting from the embodiment shown in FIG. 2A.

As shown in FIGS. 1 and 2A, hollow tube 20 passes radially through tubular member 1 through the centerpoints of each orifice 5, 6. This has been done for the sake of symmetry. It is, however, appropriate to pass hollow tube 20 through the side walls of hollow tubular member 1 at other points such as, for example, 90° from the position shown while achieving the beneficial mixing characteristics desired herein. It is crucial in practicing the present invention that low viscosity fluid entry port 15 be positioned such that the low viscosity fluid is discharged at a point substantially coincident with the point of substantial mutual tangency 19 of orifices 5 and 6. By so situating entry port 15, the low viscosity fluid forms an elongated flat plane 31 across the diameter of the pipe as shown in FIG. 2B. This greatly enhances molecular diffusion between the low viscosity and high viscosity fluids. This increases the surface area available for diffusion by a factor typically 25 to 50 times, while at the same time increasing the value of dC/dr.

As stated previously, the present invention is particularly advantageous in mixing fluids of markedly contrasting viscosities. Ideally, the viscosity ratio of the first and second fluids should be approximately 1000:1 or more to most adequately take advantage of the motionless mixer presented herein.

Constriction 9 forming the mixing zone from which the two or more orifices are formed can assume a number of configurations. It has been found that when the side walls of constriction 9 are radially perpendicular to the circumference of hollow tubular member 1, some of the fluid being mixed can settle in dead zones proximate the interior side walls of the hollow tubular member. Thus, it is preferable, as shown in FIG. 1, to slope the side walls of constriction 9, said slope most typically being at a 45° angle to the centerline of hollow tubular member 1.

Figure 3:
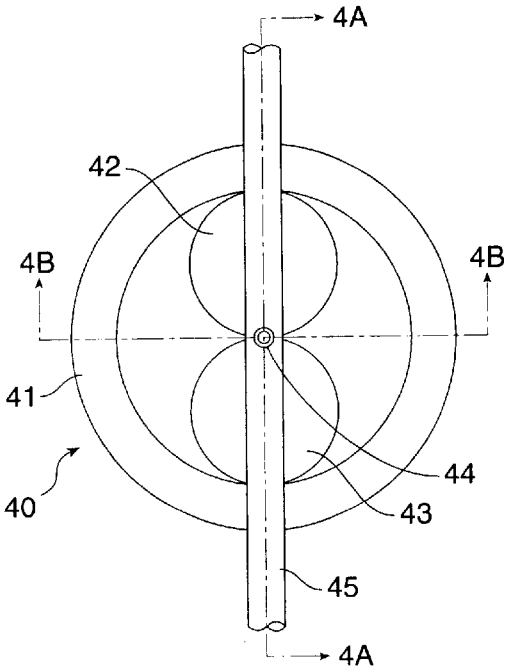
FIG. 3 is an end view of the mixing device of the present invention.

Referring to FIG. 3, mixing device 40 comprises a substantially hollow tubular member 41 including orifices 42 and 43 for passage of a relatively high viscosity first fluid. As in the embodiments shown in the '007 patent, the cross-sections of the orifices are shown to be substantially circular but obvious modifications such as oval shapes and the like are contemplated.

Orifices 42 and 43 have longitudinal axes which are substantially parallel to longitudinal axis 46 of said substantially hollow tubular member 41.

Low viscosity second fluid discharge tube 44 is shown extending substantially perpendicularly from hollow tube 45 which is shown radially extending through the side walls of elongated hollow tubular member 41.

The present invention differs from that disclosed in the '007 patent in providing the low viscosity second fluid port in the form of a second fluid discharge tube 44 located at said point of substantial mutual tangency wherein the second fluid discharge tube is characterized as having an axis 48 substantially co-extensive with said longitudinal axis 46 of said substantially hollow tubular member 41.

In addition to the above, the present invention is unique in providing gap 47 proximate said point of substantial mutual tangency of orifices 42 and 43 surrounding said second fluid discharge tube 44. Gap 47 enables a quantity of first fluid to pass through said gap as said first fluid passes through orifices 42 and 43. It was observed that when a relatively small amount of first high viscosity fluid washes over the outer surface of second fluid discharge tube 44, the observed phenomenon of the second fluid reaching the walls of the tubular member is greatly minimized thus enhancing the mixing operation.

Experimental Observations

Figure 4A:
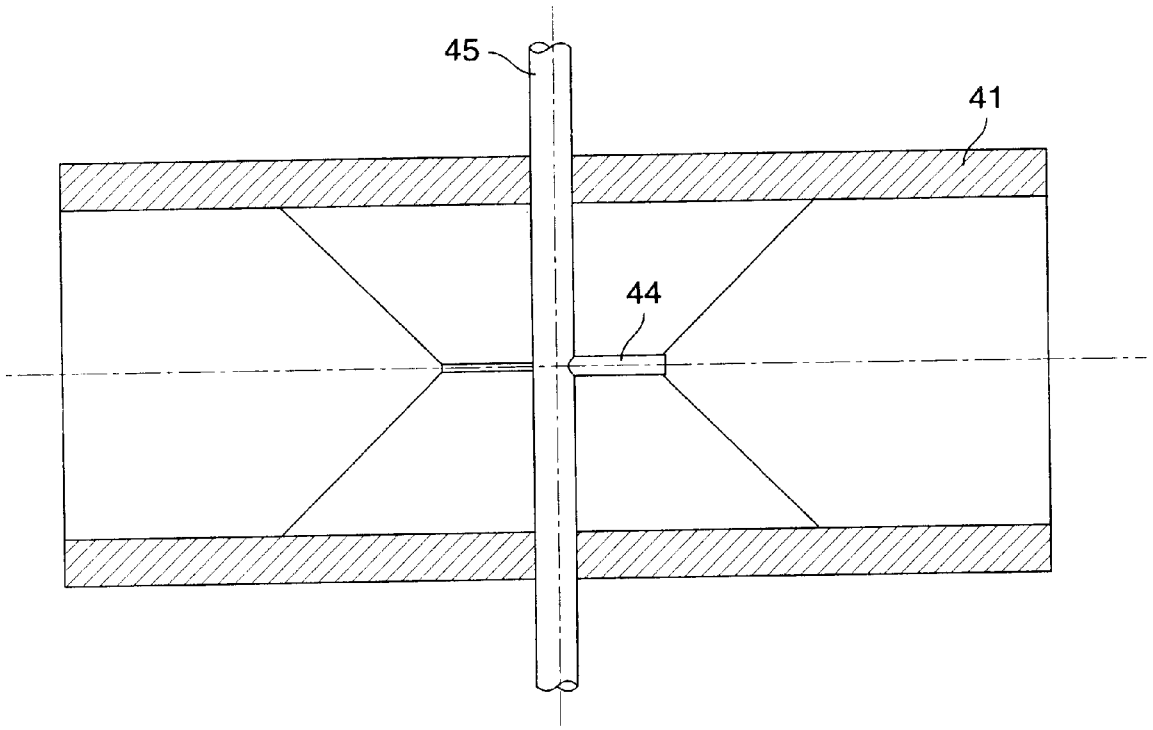
FIGS. 4A and 4B are cross-sectional views taken along the lines 4A—4A and 4B—4B of FIG. 3 respectively.
Figure 4B:
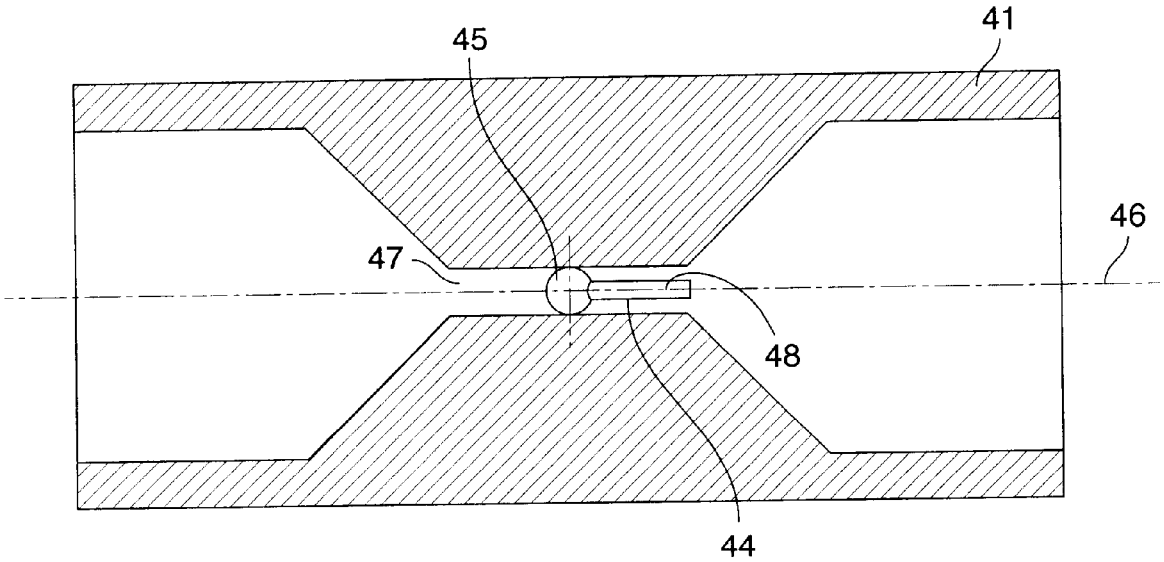

A test unit having the elements of the present invention was configured from acrylic so that the interior mixing operation of various additives could be observed. A conduit was configured having a diameter of 1½ inches. A gap corresponding to gap 47 (FIG. 4B) was created having width of 0.20 inches in the vicinity of an additive to 0.10 inches in diameter with an orifice measuring 0.074 inches as the second fluid port.

Flow tests were conducted covering a flow rate range of 0.5 inches per second to 2 inches per second. The additive flow rate was controlled to arrange from 0.10 to 2% of the main flow. Viscosities ranging from 2700 cp to 10,000 cp were used. This range of perimeters gave a Reynolds number range for the tests from 0.048 to 0.72, a 15–1 range.

It was observed that the configuration of the present invention generated a very stable thin sheet of additive over the entire flow rate range and viscosity range noted above. No additive accumulation around the feed tube or additive migration to the walls of the main conduit was observed. It was observed that a wide Reynolds number range was successfully handled and, thus, it was determined that the Reynolds numbers of the various additives was not critical in the operation of the present invention. In addition, the velocity of additive input relative to main flow velocity was found to be not critical. In these tests, the additive velocity ranged from eight times that of the main flow down to 1/10 of the main flow. In all cases, it was observed that a good thin and controlled sheet was generated.

I claim:

1. In a device for the mixing of two or more fluids comprising an elongated substantially hollow tubular member having side walls and a longitudinal axis in which said hollow tubular member is constricted intermediate its ends with a mixing zone comprising (A) at least two orifices for carrying a first fluid having substantially circular cross-sections and having longitudinal axes which are substantially parallel to the longitudinal axis of the substantially hollow tubular member, said orifices being situated and sized within the said substantially hollow tubular member such that said substantially circular cross-sections have a point of substantial mutual tangency; and (B) a fluid entry port for discharging the second fluid at a point substantially coincident with the point of substantial mutual tangency of said orifices, the improvement wherein said fluid entry port for discharging the second fluid comprises a second fluid discharge tube located at said point of substantial mutual tangency, the second fluid discharge tube being provided with an axis substantially coextensive with said longitudinal axis of said substantially hollow tubular member and wherein a gap is provided proximate said point of substantial mutual tangency surrounding said second fluid discharge tube to enable a quantity of first fluid to pass through said gap as said first fluid passes through said at least two orifices.

2. The device of claim 1 wherein said at least two orifices for carrying a first fluid are provided with side walls which are tapered with respect to the side walls of the elongated hollow tubular member.

3. The device of claim 2 wherein said taper is approximately 45° with respect to the side walls of the elongated hollow tubular member.

* * * * *